US006149795A

United States Patent [19]

Oelund et al.

[11] Patent Number: 6,149,795

[45] Date of Patent: Nov. 21, 2000

[54] FUNGUS RESISTANT BORIC ACID-SULFURIC ACID ANODIZING

[75] Inventors: John C. Oelund, Clinton; Warren J. Fullen, Kent; David L. Crump, Bonney Lake, all of Wash.

[73] Assignee: The Boeing Company, Seattle, Wash.

[21] Appl. No.: 09/238,864

[22] Filed: Jan. 27, 1999

Related U.S. Application Data

[60] Provisional application No. 60/105,772, Oct. 27, 1998.

[51] Int. Cl.[7] ..... C25D 11/08

[52] U.S. Cl. ..... 205/329; 205/328

[58] Field of Search ..... 205/328, 329

[56] References Cited

U.S. PATENT DOCUMENTS

| | | | |
|---|---|---|---|
| 4,159,927 | 7/1979 | Bernard et al. | 204/58 |
| 4,894,127 | 1/1990 | Wong et al. | 204/58.5 |

*Primary Examiner*—Kathryn Gorgos
*Assistant Examiner*—Christopher M. Keehan
*Attorney, Agent, or Firm*—Paul C. Cullom, Jr.

[57] ABSTRACT

An improved method of anodizing an aluminum or aluminum alloy workpiece including the steps of: (a) providing an aqueous anodizing bath consisting essentially by weight of about 3 to 5 percent sulfuric acid, from about 0.5 to 1 percent boric acid, not more than about 5.0 g/L aluminum ion, not more than about 0.2 percent chloride ion, and a fungistat consisting of benzoic acid, a water-soluble salt of benzoic acid selected from the group consisting of sodium benzoate, potassium benzoate, or lithium benzoate, or mixtures thereof, the fungistat having a concentration in the range of about one part per million (1 ppm) to about ten thousand parts per million (10,000 ppm) by weight; (b) maintaining the bath at a temperature from about 70 to about 90 degrees F.; (c) immersing the workpiece in the bath; (d) ramping the voltage applied across the workpiece in the bath from about 5 to about 20 volts such that the current density is substantially uniform across the workpiece and the average current density does not exceed about 10 amperes per square foot; and (e) maintaining the workpiece in the bath for a time such that an adherent coating of aluminum oxide is applied thereto having a coating weight between about 200 and 600 milligrams per square foot. An improved bath for anodizing aluminum or aluminum alloy workpieces comprising an aqueous anodizing solution consisting essentially by weight of: (a) from about 3 to 5 percent sulfuric acid; (b) from about 0.5 to 1 percent boric acid; (c) not more than about 5.0 g/L aluminum ion; (d) not more than about 0.2 percent chloride ion, and (e) a fungistat consisting of benzoic acid, a water-soluble salt of benzoic acid selected from the group consisting of sodium benzoate, potassium benzoate, or lithium benzoate, or mixtures thereof, the fungistat having a concentration in the range of about one part per million (1 ppm) to about ten thousand parts per million (10,000 ppm) by weight.

4 Claims, No Drawings

FUNGUS RESISTANT BORIC ACID-SULFURIC ACID ANODIZING

CROSS-REFERENCE TO RELATED APPLICATION

This application claims the benefit of U.S. Provisional Application No. 60/105,772, filed Oct. 27, 1998.

BACKGROUND OF THE INVENTION

This invention relates to an improved method of anodizing aluminum and its alloys without the use of chromium-containing chemicals. More particularly, the invention relates to a method of using aqueous solutions of sulfuric and boric acids to achieve desired coating weights under well-controlled conditions. This invention is an improvement to the invention described in Wong et al., U.S. Pat. No. 4,894,127 (the "Wong et al. patent"), issued Jan. 16, 1990, "Method For Anodizing Aluminum." The term "aluminum" as used herein includes aluminum and aluminum alloys.

The Wong et al. patent describes a controlled method for anodizing aluminum using an aqueous solution of boric and sulfuric acids. The boric acid-sulfuric acid anodizing solution (as described in the Wong et al. patent) is in production use and it has been found to support the growth of a common fungus (genus Alternaria) in the solution that can interfere with the anodizing and further processing of aluminum workpieces, for example, aircraft parts.

The present invention is an improved boric acid-sulfuric acid anodizing solution that prevents the growth of the fungus and at the same time without causing any hindrance to the effectiveness of the electrochemical process (the anodizing process) being performed in the tank. The fungal growth is inhibited by the addition of a fungistat to the boric acid-sulfuric acid anodizing solution. The specific fungistat is benzoic acid or a water-soluble salt of benzoic acid, such as sodium benzoate, potassium benzoate, or lithium benzoate.

The use of benzoic acid as a fungistat is known in the prior art. Hence, the present invention is not the use of benzoic acid as a fungistat per se. Rather, the present invention is based on the discovery that benzoic acid or a water-soluble salt of benzoic acid is compatible with and can be successfully used in an anodizing process in combination with the three-component chemical solution described in the Wong et al. patent (consisting of water, boric acid, and sulfuric acid) without hindering the effectiveness of the basic electrochemical (anodizing) process. Thus, another aspect of the present invention is the improved four-component anodizing solution (consisting of water, boric acid, sulfuric acid, and a fungistat) that inhibits the growth of fungus in the bath. Qualification testing has proved that the four-component anodizing solution is safe and effective for anodizing aluminum workpieces.

The processing requirements, parameters, and specifications for this new four-component boric acid-sulfuric acid anodizing chemical mixture are the same as those specified in the Wong et al. patent for the three-component boric acid-sulfuric acid anodizing chemical mixture.

BRIEF SUMMARY OF THE INVENTION

As stated above, this invention is an improvement to the invention described in Wong et al., U.S. Pat. No. 4,894,127, issued Jan. 16, 1990, "Method For Anodizing Aluminum." The Wong et al. patent specifies a controlled method for anodizing aluminum workpieces using an aqueous solution of sulfuric and boric acids. The specified boric acid-sulfuric acid anodizing solution of the Wong et al. patent has been found to support the growth of a common fungus (genus Alternaria) that can interfere with anodizing and part processing. The presence of sizable fungus colony clusters can cause problems in manufacturing processes that often follow the anodizing process, such as sealing, priming, and painting. This invention is an improved boric acid-sulfuric acid anodizing solution that inhibits the growth of the fungus.

One aspect of the invention is an improved method of anodizing an aluminum or aluminum alloy workpiece comprising the steps of:

(a) providing an aqueous anodizing solution consisting essentially by weight of about 3 to 5 percent sulfuric acid, from about 0.5 to 1 percent boric acid, not more than about 5.0 g/L aluminum ion, not more than about 0.2 percent chloride ion, and a fungistat consisting of benzoic acid, a water-soluble salt of benzoic acid selected from the group consisting of sodium benzoate, potassium benzoate, or lithium benzoate, or mixtures thereof, the fungistat having a concentration in the range of about one part per million (1 ppm) to about ten thousand parts per million (10,000 ppm) by weight;

(b) maintaining the bath at a temperature from about 70 to about 90 degrees F.;

(c) immersing the workpiece in the bath;

(d) ramping the voltage applied across the workpiece in the bath from about 5 to about 20 volts such that the current density is substantially uniform across the workpiece and the average current density does not exceed about 10 amperes per square foot; and (e) maintaining the workpiece in the bath for a time such that an adherent coating of aluminum oxide is applied thereto having a coating weight between about 200 and 600 milligrams per square foot.

Another aspect of the invention is an improved bath for anodizing aluminum or aluminum alloy workpieces comprising an aqueous anodizing solution consisting essentially by weight of:

(a) from about 3 to 5 percent sulfuric acid;

(b) from about 0.5 to 1 percent boric acid;

(c) not more than about 5.0 g/L aluminum ion;

(d) not more than about 0.2 percent chloride ion; and (e) a fungistat consisting of benzoic acid, a water-soluble salt of benzoic acid selected from the group consisting of sodium benzoate, potassium benzoate, or lithium benzoate, or mixtures thereof, the fungistat having a concentration in the range of about one part per million (1 ppm) to about ten thousand parts per million (10,000 ppm) by weight.

DETAILED DESCRIPTION OF THE INVENTION

The anodizing method of this invention is effective for applying an aluminum oxide coating on aluminum with a chromium-free solution of sulfuric and boric acids. The anodized coating produced is at least comparable to and, in terms of corrosion resistance, superior to like anodic coatings applied in chromium ion containing baths.

Prior art processes involving sulfuric acid and sulfuric acid-boric acid anodizing baths required and resulted in relatively high coating weights. Such weights were desired to obtain acceptable surface protection. The subject method provides lower coating weight aluminum oxide coatings with corrosion resistance and paint adhesion properties at least as good as those of these prior art thicker coatings. Furthermore, the subject method controls the coating weight of anodized products by carefully regulating anodizing rates.

In a typical preferred practice, an aluminum alloy workpiece is degreased and subjected to alkaline cleaning followed by a deoxidizing rinse.

As in Wong et al. U.S. Pat. No. 4,894,127, the present bath is made up of about 3 to 5 weight percent sulfuric acid and about 0.5 to 1 weight percent boric acid. This is about 30.5 to 52 g/L sulfuric acid and about 5.2 to 10.7 g/L boric acid. The bath should contain no more than about 5.0 g/L aluminum ions and 0.2 g/L chloride ions to insure controlled anodizing conditions.

The sulfuric acid may be 66° Baume commercial grade and the boric acid may be technical grade. A preferred anodizing bath comprises 45 g/L sulfuric acid and 8 g/L boric acid.

The workpiece is hung or mounted on a conductive titanium rack and lowered into the anodizing bath with the current on or with the current off so long as it is applied within a few minutes. The voltage is ramped up from an initial value of 5 volts or less to a maximum of about 20 volts, and preferably about 15±1 volts, at a rate not exceeding about 5 volts/minute. The bath is agitated during anodizing.

Aluminum alloys with Aluminum Association designations in the 2000 and 7000 series are used in modem aircraft, for example, but not limited to the 2024, 2324, 7050, 7150, 7178 and 7075 alloys. It is necessary to use a relatively low current density in order to apply thin but tough anodized coatings to these alloys in sulfuric-boric acid solutions. The preferred current density is less than 10 A/ft$^2$ and preferably about 5±2 A/ft$^2$. The preferred current density is also a function of the alloy to be anodized.

The bath is maintained at room temperature of about 80°. The preferred temperature range for anodizing in our method is near room temperature, preferably in the range of about 80°±10° F., and most preferably about 76° to 84° F. Heating and cooling means may be provided for anodizing tanks as needed.

The present improved boric acid-sulfuric acid anodizing solution is composed of: (a) a dissolved fungistat (benzoic acid, a water-soluble salt of benzoic acid (for example, sodium benzoate, potassium benzoate, or lithium benzoate), or mixtures thereof) having a concentration in the operable range of about one part per million (1 ppm) to about ten thousand parts per million (10,000 ppm) by weight of the fungistat; and (b) the remainder being the aqueous boric acid-sulfuric acid anodizing solution as specified above. The preferred fungistats are benzoic acid (99.0% minimum $C_6H_5COOH$) and sodium benzoate (99.0% minimum $C_6H_5COONa$). The most preferred fungistat is sodium benzoate because it is highly soluble in water. The preferred concentration range of the dissolved fungistat is about 1 ppm to about 100 ppm by weight.

It should be noted that the solid benzoic acid flakes are sparingly soluble in water at the bath temperature of about 70° F. to about 90° F. Therefore, for additions to a bath, the benzoic acid should be dissolved in warn water at a concentration of less than 2 g/L. The concentrated solution may be added to the bath as part of make-up water or it may be used as part of the initial bath charge. Processing is not advised if undissolved flakes of benzoic acid are visible on the surface of the bath. Sodium benzoate is preferred because it may be added directly to the bath and it will quickly dissolve.

Testing has been carried out to demonstrate that this improved boric acid-sulfuric acid anodizing solution is effective at prevention of fungal growth in boric acid-sulfuric acid anodizing, and that the new anodizing solution performs no differently in rigorous qualification testing than the previous boric acid-sulfuric acid anodizing solution specified in Wong et al. U.S. Pat. No. 4,894,127.

Controlled laboratory tests were performed to show that the improved boric acid-sulfuric acid anodizing solution does not affect the anodizing process or damage the aluminum parts, and to qualify the process for factory testing. The laboratory tests compared a test tank with fungistat added to the original boric acid-sulfuric acid anodizing mixture (as specified in Wong et al. U.S. Pat. No. 4,894,127) against a control tank with the original boric acid-sulfuric acid anodizing mixture (as specified in the Wong et al. patent). These engineering qualification tests included dry and wet paint adhesion tests, scanning electron microscope examination of the anodized coating, anodized coating weight, percent seal hydration tests, corrosion resistance (ASTM B117, 336 hour salt spray test), primer/top coat rivet chipping, and room temperature primer impact. The tests were performed on bare (no cladding) aluminum alloy 2024-T3 test panels. These tests showed no detectable difference between the panels anodized in the test tank containing the fungistat added to the original boric acid-sulfuric acid anodizing mixture and the panels anodized in the control tank containing only the original boric acid-sulfuric acid anodizing mixture.

The corrosion resistance, paint adhesion, coating weight and percent seal hydration tests were performed at a high and low level of boric acid (about 5.2 and 10.7 g/L) and at mid-range for the sulfuric acid (about 40 g/L). High and low values for the boric acid were tested because the fungistat is present in the bath at a significant level relative to the boric acid concentration. The engineering tests showed no significant differences between the test boric acid-sulfuric acid anodizing solution with fungistat added and the control boric acid-sulfuric acid anodizing solution. The test and control tanks were identical in size and both tanks used the same rectifier for their voltage supply. The temperature difference between the two tanks was less than two degrees F. for all testing, with the individual tank bath temperatures being 80±2° F. The boric acid-sulfuric acid anodizing bath compositions of boric and sulfuric acid (except for the fungistat concentration levels) were maintained to be consistent between the test tank and the control tank, at the levels specified for the high and low boric acid concentrations above. The total anodizing time for the tests was 18 minutes. Actual tests were performed using test panels that were not sealed and test panels that had been sealed using a dilute chromate sealing solution (as described in the Wong et al. patent).

Factory trials for the improved boric acid-sulfuric acid anodizing solution have been performed. These trials were performed in a boric acid-sulfuric acid anodizing production tank with fungal contamination levels of about 20 colony forming units per milliliter (fungus of the genus Alternaria). This demonstrated the effectiveness of the fungistat and showed there was no significant change in coating weight for the improved boric acid-sulfuric acid anodizing process in actual production use.

In our preferred practice, the fungistat is added to a newly prepared boric acid-sulfuric acid anodizing bath that has no fungus present, and it serves to prevent or inhibit the growth. The addition of the fungistat will not necessarily remove or dissolve any fungal biomass already present in a boric acid-sulfuric acid anodizing solution, but it will prevent or inhibit any further growth.

The present invention has been so disclosed that one of ordinary skill will be able to make and use the invention and effect various changes, alterations and substitutions of equivalents without departing from the broad concepts herein disclosed. It is therefore intended that the scope of Letters Patent issued hereon be limited only by the definition contained in the appended claims and equivalents thereof.

What is claimed is:

1. An improved method of anodizing an aluminum or aluminum alloy workpiece and concurrently inhibiting the growth of fungus without hindering the effectiveness of the anodizing process, comprising the steps of:

(a) providing an aqueous anodizing bath consisting essentially by weight of about 3 to 5 percent sulfuric acid, from about 0.5 to 1 percent boric acid, not more than about 5.0 g/L aluminum ion, not more than about 0.2 percent chloride ion, and a fungistat consisting of benzoic acid, a water-soluble salt of benzoic acid selected from the group consisting of sodium benzoate, potassium benzoate, or lithium benzoate, or mixtures thereof, said fungistat having a concentration in the range of about one part per million (1 ppm) to about ten thousand parts per million (10,000 ppm) by weight;

(b) maintaining said bath at a temperature from about 70 to about 90 degrees F.;

(c) immersing said workpiece in said bath;

(d) ramping the voltage applied across said workpiece in said bath from about 5 to about 20 volts such that the current density is substantially uniform across the workpiece and the average current density does not exceed about 10 amperes per square foot; and (e) maintaining said workpiece in said bath for a time such that an adherent coating of aluminum oxide is applied thereto having a coating weight between about 200 and 600 milligrams per square foot.

2. An improved method of anodizing an aluminum or aluminum alloy workpiece and concurrently inhibiting the growth of fungus without hindering the effectiveness of the anodizing process, comprising the steps of:

(a) providing an aqueous anodizing bath consisting essentially by weight of about 3 to 5 percent sulfuric acid, from about 0.5 to 1 percent boric acid, not more than about 5.0 g/L aluminum ion, not more than about 0.2 percent chloride ion, and a fungistat consisting of sodium benzoate, said fungistat having a concentration in the range of about one part per million (1 ppm) to about ten thousand parts per million (10,000 ppm) by weight;

(b) maintaining said bath at a temperature from about 70 to about 90 degrees F.;

(c) immersing said workpiece in said bath;

(d) ramping the voltage applied across said workpiece in said bath from about 5 to about 20 volts such that the current density is substantially uniform across the workpiece and the average current density does not exceed about 10 amperes per square foot; and (e) maintaining said workpiece in said bath for a time such that an adherent coating of aluminum oxide is applied thereto having a coating weight between about 200 and 600 milligrams per square foot.

3. An improved bath for anodizing aluminum or aluminum alloy workpieces and concurrently inhibiting the growth of fungus without hindering the effectiveness of the anodizing process, comprising an aqueous anodizing solution consisting essentially by weight of:

(a) from about 3 to 5 percent sulfuric acid;

(b) from about 0.5 to 1 percent boric acid;

(c) not more than about 5.0 g/L aluminum ion;

(d) not more than about 0.2 percent chloride ion, and (e) a fungistat consisting of benzoic acid, a water-soluble salt of benzoic acid selected from the group consisting of sodium benzoate, potassium benzoate, or lithium benzoate, or mixtures thereof, said fungistat having a concentration in the range of about one part per million (1 ppm) to about ten thousand parts per million (10,000 ppm) by weight.

4. An improved bath for anodizing aluminum or aluminum alloy workpieces and concurrently inhibiting the growth of fungus without hindering the effectiveness of the anodizing process, comprising an aqueous anodizing solution consisting essentially by weight of:

(a) from about 3 to 5 percent sulfuric acid;

(b) from about 0.5 to 1 percent boric acid;

(c) not more than about 5.0 g/L aluminum ion;

(d) not more than about 0.2 percent chloride ion, and (e) a fungistat consisting of sodium benzoate, said fungistat having a concentration in the range of about one part per million (1 ppm) to about ten thousand parts per million (10,000 ppm) by weight.

* * * * *